US006976474B1

(12) United States Patent
Coldren et al.

(10) Patent No.: US 6,976,474 B1
(45) Date of Patent: Dec. 20, 2005

(54) MECHANICALLY ACTUATED, ELECTRONICALLY CONTROLLED FUEL INJECTION SYSTEM

(75) Inventors: Dana R. Coldren, Fairbury, IL (US); Stephen R. Lewis, Chillicothe, IL (US); Michael R. Huffman, Dunlap, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 10/894,109

(22) Filed: Jul. 19, 2004

(51) Int. Cl.[7] ..... F02M 37/04

(52) U.S. Cl. ..... 123/446; 123/458; 123/496; 239/585.1

(58) Field of Search ..... 123/446, 506, 123/467, 458, 500, 501, 502, 503, 299, 496; 239/88–96, 239/585.1–585.5

(56) References Cited

U.S. PATENT DOCUMENTS

| | | | | |
|---|---|---|---|---|
| 6,113,014 | A | 9/2000 | Coldren et al. | |
| 6,167,869 | B1 | 1/2001 | Martin et al. | |
| 6,267,306 | B1 | 7/2001 | Phillips et al. | |
| 6,279,843 | B1 | 8/2001 | Coldren et al. | |
| 6,390,070 | B2 | 5/2002 | Coldren et al. | |
| 6,405,940 | B2 | 6/2002 | Harcombe et al. | |
| 6,502,555 | B1 | 1/2003 | Harcombe et al. | |
| 6,595,189 | B2 | 7/2003 | Coldren et al. | |
| 6,684,853 | B1 | 2/2004 | Lei | |
| 6,684,854 | B2 | 2/2004 | Coldren et al. | |
| 6,779,741 | B2 * | 8/2004 | Boehland | 239/88 |
| 2002/0185112 | A1 * | 12/2002 | Lei | 123/446 |
| 2003/0111061 | A1 * | 6/2003 | Coldren et al. | 123/514 |

* cited by examiner

*Primary Examiner*—Weilun Lo
(74) *Attorney, Agent, or Firm*—Liell & McNeil

(57) ABSTRACT

A fuel injection system includes a fuel pressurizer that may be cam actuated. The fuel injection system also includes an electronically controlled spill valve and an electronically controlled needle control valve. The energization of the electronically controlled spill valve closes a fuel pressurization chamber to a drain passage to allow fuel pressure in the fuel injector to build to injection levels. The electronically controlled needle control valve controls whether high or low fuel pressure is applied to a closing hydraulic surface associated with a direct control needle valve. The fuel injection system includes a hydraulic circuitry that allows for fuel injection to occur by either maintaining the electronically controlled needle control valve in a de-energized state, or by de-energizing the same, after fuel pressure within the fuel injector has built to injection levels. With a de-energize to inject hydraulic circuitry associated with the direct control needle valve, the fuel injection system can prevent overpressurization in the event of electrical failure in the needle control electronic circuitry. This also provides a fuel engine with a limp home capability in the case of such an electronic problem. In addition, the fuel injection system can have reduced overall power requirements that can lead to downsizing and other cost saving advantages.

20 Claims, 3 Drawing Sheets

19
30
31
26
42
43
38
35
18
44
39
46
45
20
57
58
59
28
55
34
56
62
50
51
52
61
32
66
40
60
63
33
64
67
24

MECHANICALLY ACTUATED, ELECTRONICALLY CONTROLLED FUEL INJECTION SYSTEM

TECHNICAL FIELD

The present disclosure relates generally to fuel injection systems that are mechanically actuated and electronically controlled, and more particularly to such a fuel injection system in which an electronically controlled needle control valve is de-energized to inject fuel.

BACKGROUND

Mechanically actuated fuel injectors typically have a fuel pressurizer that includes a plunger that is driven to reciprocate by a cam rotated by an engine. The fuel pressurizer can be in a separate body from the fuel injector, such as in a unit pump. However, more typically, the fuel pressurizer and injection nozzle are carried in a common injector body. Some electronic control was initially introduced to these fuel injection systems by including an electronically controlled spill valve. In other words, as the cam rotates, fuel pressure does not develop in the fuel injector until the spill valve is closed. When the spill valve is open, fuel displaced by downward movement of the plunger is merely recirculated back to tank.

As the demands for ever more flexible fuel injection rate shapes have grown, and better control over timing arrived, these fuel injection systems were further improved by incorporation of electronic control over movement of the nozzle needle valve member. Such a fuel injector is shown, for example, in co-owned U.S. Pat. No. 6,279,843 to Coldren et al. These fuel injectors have demonstrated the ability to produce a variety of different fuel injection profiles at least in part by varying the relative timing of electronically opening and closing the spill valve relative to the energization and de-energization of the electrical actuator controlling a needle control valve. Depending upon the position of the needle control valve, pressure is either applied or relieved to a closing hydraulic surface associated with the nozzle needle valve member. In a typical injection event, the cam rotates, the spill valve is closed via a first electrical actuator, and then injection is initiated by energizing a second electrical actuator to relieve pressure on the closing hydraulic surface of the needle valve member. There remains room for improvement over these fuel injection systems.

In certain rare circumstances, these fuel injection systems have the potential for becoming overpressurized in a way that could possibly lead to injector as well as engine damage. For instance, it is possible for the electrical circuitry associated with the needle control valve to fail while the electrical circuitry associated with spill control remains active. In such circumstances, it is possible for the fuel injector to become pressurized in a typical manner by electronically closing the spill valve; however, no injection is able to occur since a failure in the electronics for the needle control valve prevent the nozzle from opening, since the electronic failure prevents energization of a second electrical actuator to relieve pressure on the closing hydraulic surface of the needle valve member. As such, the plunger will continue its downward movement, but the fuel in the fuel injector will have nowhere to go. In these rare circumstances, tip breakage can occur or the linkage between the rotating cam and the injector tappet can become overstressed and break. In any event, this potential failure mode can possibly result in catastrophic engine failure if even one fuel injector becomes overpressurized and its tip breaks off into an engine cylinder.

The present disclosure is directed to overcoming one or more of the problems set forth above.

SUMMARY OF THE DISCLOSURE

In one aspect, a fuel injection system includes a fuel pressurizer that includes a cam driven plunger, a fuel pressurization chamber and an electronically controlled spill valve that includes a first electrical actuator. A needle valve includes a member with a closing hydraulic surface exposed to fluid pressure in a needle control chamber. An electronically controlled needle control valve includes a second electrical actuator operably coupled to a control valve member that is biased toward a first position, but moveable to a second position when the second electrical actuator is energized. The needle control chamber is fluidly blocked from the fuel pressurization chamber when the control valve member is in its first position, but fluidly connected to the fuel pressurization chamber when the control valve member is in its second position. The needle control chamber is fluidly connected to a low pressure drain when the control valve member is in either of its first and second positions. The fuel pressurizer and the needle control valve can either be in the same or separate bodies.

In another aspect, a method of injecting fuel includes a step of energizing a first electrical actuator to close a spill valve and build pressure within a fuel pressurization chamber. A second electrical actuator is de-energized to relieve pressure in the needle control chamber and open a nozzle outlet set to inject fuel from the fuel injector. Fuel pressure is controlled in the needle control chamber at least in part by always maintaining a fluid connection between the needle control chamber and a low pressure drain.

DETAILED DESCRIPTION

Figure 1:
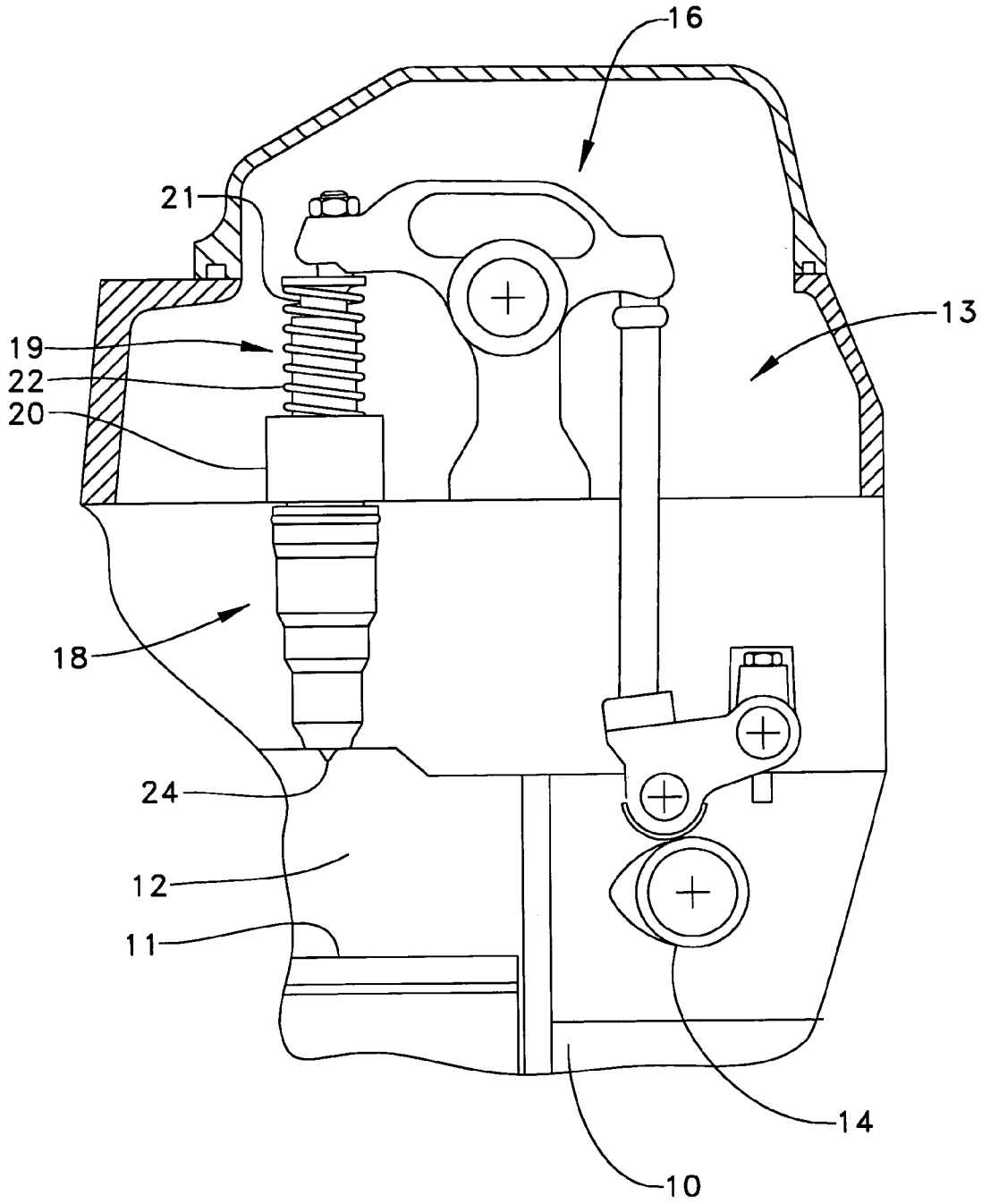
FIG. 1 is a side diagrammatic view of a engine with a fuel injection system according to one aspect of the present disclosure.

Referring now to FIG. 1, an engine 10 includes a reciprocating piston 11 in a cylinder 12. A fuel injection system 13 is driven by a cam 14 via a rocker arm assembly 16 to actuate a fuel injector 18. Fuel injector 18 includes an injector body 20 within which a fuel pressurizer 19 is partially housed. Fuel pressurizer 19 includes a tappet 21 that is linked to rocker arm assembly 16 in a manner well known in the art. Contact between the tappet and rocker arm assembly is maintained via a return spring 22 in a conventional manner. Those skilled in the art will recognize that the lobe of cam 14 causes tappet 21 to be driven downward to pressurize fuel in fuel pressurizer 19, which is then injected into cylinder 12 via nozzle outlet set 24.

Figure 2:
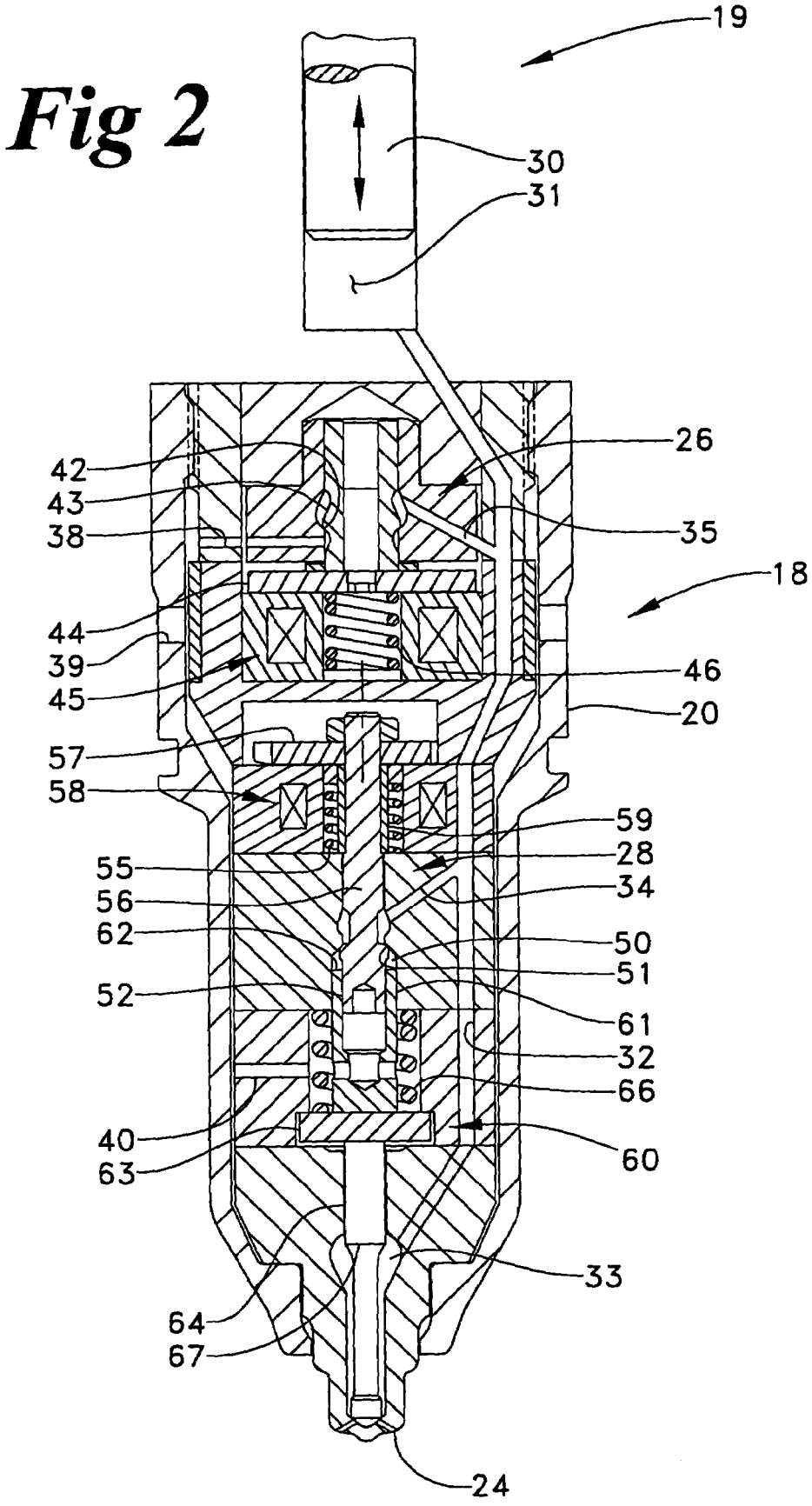
FIG. 2 is a partial sectioned side diagrammatic view of a fuel injector from the fuel injection system shown in FIG. 1.

Referring now in addition to FIG. 2, fuel pressurizer 19 includes a plunger 30 that is operably coupled to tappet 21. Plunger 30 and fuel injector body 20 together define a fuel pressurization chamber 31 that is fluidly connected to nozzle chamber 33 via a nozzle supply passage 32. The operation of fuel injector 18 is controlled by an electronically controlled spill valve 26 and an electronically controlled needle control valve 28. Electronically controlled spill valve 26 controls when the fuel in nozzle supply passage 32 is pressurized to injection levels, and the electronically controlled needle control valve 28 controls the action of direct controlled needle valve 60 to open and close fluid connection between nozzle outlet set 24 and nozzle chamber 33.

Electronically controlled spill valve 26 includes a first electrical actuator 45 with an armature 44 operably coupled to move a spill valve member 43. In other words, the spill valve member 43 moves with armature 44. A biasing spring 46 biases armature 44 and spill valve member 43 out of contact with spill seat 42 to maintain a fluid connection between nozzle supply passage 32 and low pressure drain 38 via branch passage 35. Drain passage 38 is fluidly connected to fuel port 39, which is connected to a low pressure fuel reservoir (not shown). Thus, spill valve member 43 is normally biased to a position that allows fuel displaced from fuel pressurization chamber 31 to simply return to the low pressure reservoir without substantially raising fuel pressure in the fuel injector 18. However, when first electrical actuator 45 is energized, armature 44 and spill valve member 43 are pulled downward to close spill seat 42 and block the fluid connection between branch passage 35 and drain passage 38. When this occurs, and plunger 30 is being driven downward, fuel pressure within nozzle supply passage 32 rapidly rises to injection levels.

Direct control needle valve 60 includes a needle valve member 64 with an opening hydraulic surface 67 exposed to fluid pressure in nozzle chamber 33. Direct control needle valve 60 also includes a needle lift spacer 63 having a predetermined thickness that determines the needle valve lift distance in a manner well known in the art. Finally, direct control needle valve 60 includes a needle piston 61 with a closing hydraulic surface 62 exposed to fluid pressure in a needle control chamber 50. Needle valve member 64 is normally biased to a downward closed position by a biasing spring 66. When fuel pressure in nozzle chamber 33 is at injection levels sufficient to overcome biasing spring 66 (valve opening pressure) and pressure in needle control chamber 50 is relatively low, needle valve member 64 will lift to an upward open position to allow fuel to spray from nozzle outlet set 24 into the engine combustion space 12 in a manner well known in the art.

The movement of direct control needle valve 60 is controlled by the electronically controlled needle control valve 28, which includes a control valve member 56. Control valve member 56 is operably coupled to a second electrical actuator 58 via an armature 57. A biasing spring 55 normally biases armature 57 and control valve member 56 upward to a position that closes control seat 51, which separates needle control chamber 50 from branch passage 34. Branch passage 34 is fluidly connected to nozzle supply passage 32 as illustrated. However, those skilled in the art will appreciate that branch passage 34 could be fluidly connected to fuel pressurization chamber 31 in any suitable manner, such as a separate passageway apart from nozzle supply passage 32. When control valve member 56 is in the position shown in FIG. 2, where control seat 51 is closed, needle control chamber 50 is fluidly isolated from fuel pressurization chamber 31. However, needle control chamber 50 is always fluidly connected to a low pressure drain passage 40 via a leak clearance 52 between the outer diameter of control valve member 56 and an inner diameter of a bore within needle piston 61. Low pressure drain passage 40 is fluidly connected to fuel port 39 in a well known manner, such a via a clearance between the injector body 20 outer casing and the inner stacked components.

When second electrical actuator 58 is energized, armature 57 and control valve member 56 are pulled downward against the action of biasing spring 55 to open control seat 51. This creates a fluid connection between fuel pressurization chamber 31 and needle control chamber 50 via nozzle supply passage 32 and branch passage 34. However, because of the relatively restricted flow area in leak clearance 52, pressure in needle control chamber becomes relatively high. The size of closing hydraulic surface 62 along with the magnitude of the fuel pressure in needle control chamber is such that direct control needle valve 60 will move toward, or stay in, its downward closed position when fuel pressure in fuel pressurization chamber 31 is high and second electrical actuator 58 is energized to open the fluid connection between branch passage 34 and needle control chamber 50.

The movement distance of armature 57 and control valve member 56 is determined by the height of a stop spacer sleeve 59 in a known manner. In other words, electronically controlled needle control valve 28 includes a control valve member 56 that moves between control seat 51 and a stop surface located on stop spacer sleeve 59. Thus, in order to inject fuel, plunger 30 needs to be moving downward to displace fuel from fuel pressurization chamber 31, first electrical actuator 45 needs to be energized to the closed spill valve seat 42 and second electrical actuator needs to be de-energized to relieve pressure in needle control chamber 50.

Figure 3:
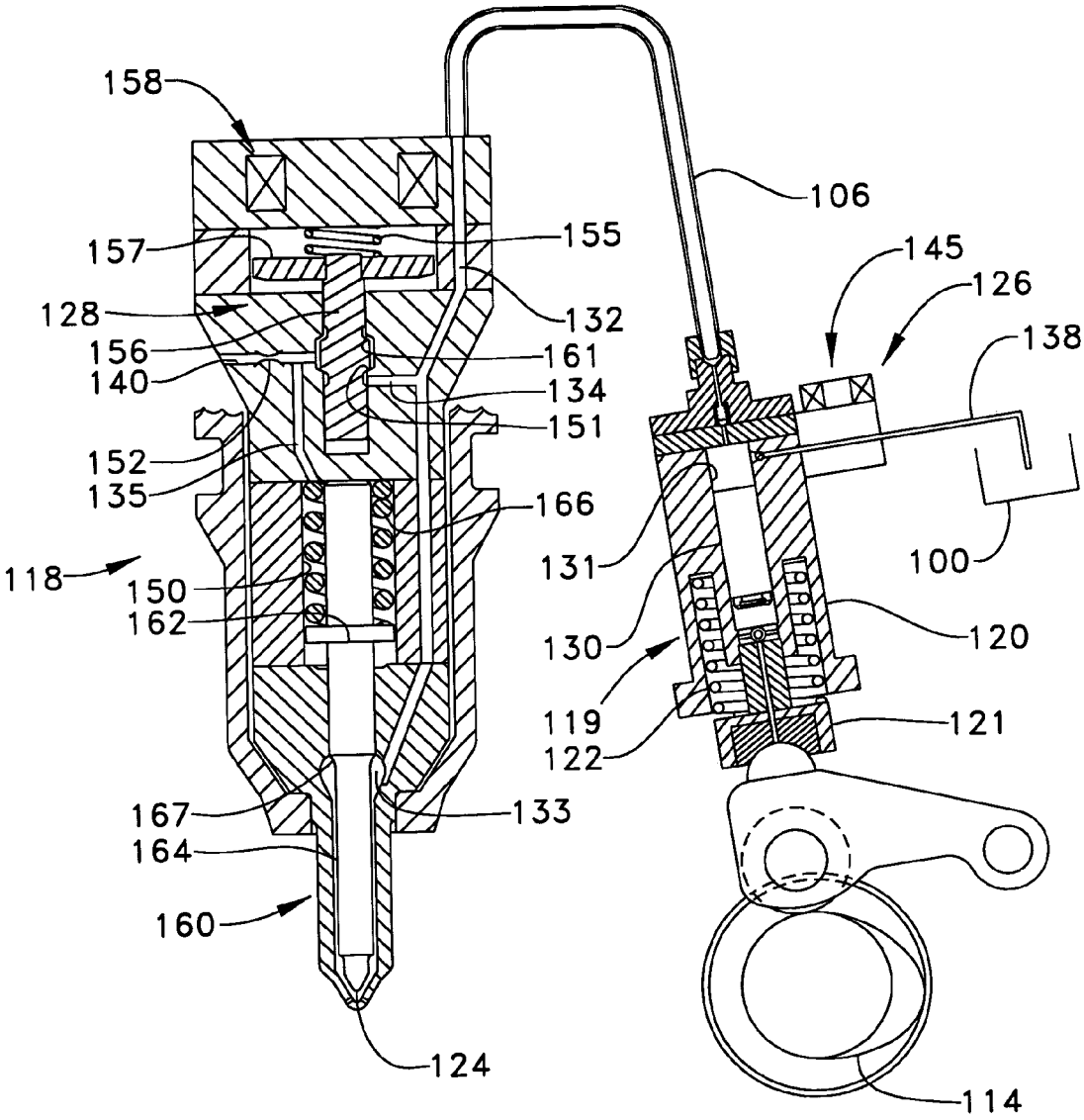
FIG. 3 is a sectioned side diagrammatic view of a fuel injection system according to another aspect of the present disclosures.

Referring now to FIG. 3, a fuel injection system 113 is similar to fuel injection system 13 discussed earlier except that fuel pressurizer 119 is in a separate unit pump body 120, instead of sharing a common injector body with the fuel injector 118. In particular, a cam 114 is operably coupled to a plunger 130 via a tappet 121 to pressurize fuel in a fuel pressurization chamber 131. The linkage between tappet 121 and rotating cam 114 is maintained by a return spring 122. When plunger 130 is driven downward, fluid is displaced from fuel pressurization chamber 131 toward low pressure reservoir 100 via spill passage 138 when electronically controlled spill valve 126 is deactivated. When first electrical actuator 145 is energized, spill valve 126 is closed, and fuel within fuel pressurization chamber 131 can build and be fed to fuel injector 118 via conduit 106.

Conduit 106 is connected to nozzle supply passage 132 that supplies fluid to nozzle chamber 133, and eventually to nozzle outlet set 124 when needle valve 160 is in its open position. Direct control needle valve 160 includes a needle valve member 164 with an opening hydraulic surface 167 exposed to fluid pressure in nozzle chamber 133, and a closing hydraulic surface 162 exposed to fluid pressure in needle control chamber 150. Needle valve member 167 is biased downward toward its closed position by a biasing spring 166.

An electronically controlled needle control valve 128 includes a control valve member 156 that is trapped to move between a control seat 151 and a stop surface 161. Control valve 128 includes a second electrical actuator 158 with an armature 157 operably coupled to move control valve member 156. A biasing spring 155 normally biases armature 157 and control valve member 156 downward to close control seat 151. When in this position, needle control chamber 150 is fluidly isolated from fuel pressurization chamber 131, since seat 151 is closed. However, needle control chamber 150 is always fluidly connected to a drain passage 140 via branch passage 135. Drain passage 140 includes a flow restriction 152 that is analogous to the leak clearance 52 of the previous embodiment. When second electrical actuator 158 is energized, control valve member 156 is lifted into contact with stop surface 161 to open control seat 151. When this occurs, needle control chamber 150 is fluidly connected to fuel pressurization chamber 131 via branch passage 135, branch passage 134, nozzle supply passage 132 and conduit 106. Preferably, opening hydraulic surface 167 and closing hydraulic surface 162 as well as the expected fuel pressure are such that needle valve member 167 will stay in, or move toward, this downward closed position, as shown, when second electrical actuator 158 is energized to open control seat 151. In the event that this occurs when needle valve member 164 is in its upward open position, needle valve member 164 is preferably hydraulically balanced such that there are substantially equal hydraulic forces pushing in an upward direction adjacent the nozzle outlets and opening hydraulic surface 167 to balance a downward hydraulic force on closing hydraulic surface 162 such that needle valve member 164 is substantially hydraulically balanced. When this occurs, the needle valve member 164 is moved toward its downward closed position under the action of biasing spring 166. Thus, this embodiment differs from the earlier embodiment in that the needle valve member 164 includes both of the opening and closing hydraulic surfaces, whereas in the earlier embodiment, a separate needle piston included the closing hydraulic surface portion of the needle valve. In addition, this embodiment differs from the earlier embodiment in that the fuel pressurizer 119 includes a unit pump 120 that is separate from the fuel injector 118, rather than being incorporated into one body as in the earlier embodiment.

INDUSTRIAL APPLICABILITY

Each injection event is initiated by the lobe of cam 14, 114 causing tappet 21, 121 to drive plunger 30, 130 to displace fuel from fuel pressurization chamber 31, 131. At a selected timing, fuel pressure is made to build within nozzle supply passage 32, 132 of fuel injector 18, 118 by energizing a first electrical actuator of 45, 145 to close the electronically controlled spill valve 26, 126. This closes the fluid connection between fuel pressurization chamber 31, 131 and low pressure drain 38, 138. If the second electrical actuator 58,158 remains unenergized, fuel pressure will build in nozzle passage 32, 132 to a valve opening pressure that is sufficient to overcome biasing spring 66, 166. When this occurs, the needle valve 60, 160 will open, and fuel will commence to spray out of nozzle outlet set 124. Such an injection event will generally have what is known in the art as a ramp shape since fuel pressure will continue to increase after needle valve 60, 160 opens.

Such a fuel injection event can be ended in one of three ways. First, the injection event can end by the cam lobe ceasing to advance plunger 30, 130 resulting in a fuel pressure drop below a valve closing pressure that results in biasing spring 66, 166 closing the needle valve 61, 161. In a second scenario, the first electrical actuator 145 can be de-energized to open the spill valve 26, 126 to relieve fuel pressure and likewise cause the needle valve 60, 160 to close. Finally, in a third scenario the injection event can be ended by energizing the second electrical actuator 58, 158 to increase fuel pressure in needle control chamber 50, 150 to cause the needle control chamber 50, 150 to be fluidly connected to nozzle supply passage 32, 132. When this occurs, the needle valve member 64, 164 will move downward toward its closed position to end the injection event. Thus, the injection ending event can be chosen independent of the cam lobe angular position, and some control over the fuel pressure at which the injection event is ended can be attained. In other words, a relatively abrupt end of injection can occur by energizing the second electrically actuator 58, 158. On the other hand, a relatively more gradual ending to the injection event can occur by either opening spill valve 26, 126 or by the cam lobe advancing beyond its peak such that the plunger 30, 130 ceases its pumping stroke.

In the event that a square front end injection rate shape is desired, the second electrical actuator 58, 158 is energized before fuel pressure in nozzle supply passage 32, 132 reaches a valve opening pressure sufficient to open the needle valve 60, 160. Thus, the plunger will continue its movement to pressurize fuel beyond the valve opening pressure, but the needle valve 60, 160 will remain closed due to the energization of second electrical actuator 58, 158 to fluidly connect the nozzle supply passage 32, 132 to the needle control chamber 50, 150. Thus, the injection event can be initiated at a relatively high pressure to produce what is known in the art as a square front end rate shape by de-energizing the second electrical actuator 58, 158 at some desired timing after fuel pressure has exceeded the valve opening pressure. This timing would correspond to de-energizing the second electrical actuator 58, 158 at some time after energizing the first electrical actuator 45, 145 to close the spill valve 26, 126.

In the event that a split injection is desired, the second electrical actuator 58, 158 is briefly energized after fuel spray is commenced to briefly close the needle valve 60, 160. Shortly thereafter, the second electrical actuator 58, 158 is again de-energized before fuel pressure has dropped below the needle valve closing pressure. Typically, this second de-energizing of the second electrical actuator 58, 158 will occur when fuel pressure is relatively high. However, it is possible to produce splits toward the end of an injection sequence by de-energizing the second electrical actuator 58, 158 toward the end of an injection event, but before fuel pressure has dropped below the needle valve closing pressure due either to the cam lobe peak passing or due to de-energizing the first electrical actuator 45, 145 to open the spill valve 26, 126.

By organizing the hydraulic circuitry as shown, the fuel injection system 13, 113 has several subtle but important advantages. First, although pressurization of the fuel injector 18, 118 is substantially avoided in the event that an electric problem prevents the second electrical actuator 58, 158 from being energized for whatever reason. In such a case, the fuel injection event would commence much like earlier fuel injectors of this type that were only equipped with an electrically controlled spill valve. This aspect of the fuel injection system provides a fail safe against both overpressurization which could potentially lead to tip breakage and possible catastrophic engine damage. In addition, this provides an engine with a limp home capability in the event of electrical problems in the circuitry of one or more of the needle control valves 28, 128 in one or more fuel valves mounted in an engine.

Still another subtle but important advantage of the de-energize-to-inject hydraulic circuitry illustrated in the fuel injection systems 13, 113 is the potential to lower the electrical power requirements of the injection system 13, 113. This lowering of power requirements is relative to a similar fuel injection system that requires two electrical actuators to be energized in order to inject fuel. The lowering of the power requirements for the fuel injection system 13, 113 can also lead to other advantages. For instance, in some similar fuel injection systems that require energize-to-inject hydraulic circuitry, the electronic control module that supplies electrical energy to the electrical actuators of the fuel injection system must be continuously cooled by circulating fuel in order to operate properly. The de-energized to inject hydraulic circuitry of the present disclosure can potentially allow the electronic control module to remain sufficiently cool without circulating fuel or another cooling fluid therearound or therethrough. Lower electrical energy power requirements for the fuel injection system can also allow for cost savings by down sizing other components associated with the system.

It should be understood that the above description is intended for illustrative purposes only, and is not intended to limit the scope of the present disclosure in any way. Thus, those skilled in the art will appreciate that other aspects, objects, and advantages of the disclosure can be obtained from a study of the drawings, the disclosure and the appended claims.

What is claimed is:

1. A fuel injector comprising:

an injector body having disposed therein a low pressure drain, a fuel pressurization chamber and a needle control chamber;

a fuel pressurizer at least partially positioned in said injector body, and including a tappet and an electronically controlled spill valve, which includes a first electrical actuator;

a needle valve that includes a member with a closing hydraulic surface exposed to fluid pressure in said needle control chamber;

an electronically controlled needle control valve that includes a biaser and a second electrical actuator operably coupled to a control valve member that is biased toward a first position by said biaser, but movable to a second position when said second electrical actuator is energized;

said needle control chamber being fluidly blocked from said fuel pressurization chamber when said control valve member is in said first position, but fluidly connected to said fuel pressurization chamber when said control valve member is in said second position; and said needle control chamber is fluidly connected to said low pressure drain when said control valve member is in either of said first and second positions.

2. The fuel injector of claim 1 wherein said needle control valve includes a single seat and a stop.

3. The fuel injector of claim 1 wherein said member is a needle piston operably coupled to a needle valve member.

4. The fuel injector of claim 1 wherein said member is a needle valve member.

5. The fuel injector of claim 1 wherein said needle control chamber fluidly connected to said low pressure drain via a flow restriction; and said needle control chamber is fluidly connected to said fuel pressurization chamber via an unrestricted passage when said control valve member is in said second position.

6. The fuel injector of claim 5 where said flow restriction includes a leak clearance between said control valve member and said member of said needle valve.

7. The fuel injector of claim 6 wherein said needle control valve includes a single seat and a stop; and said member is a needle piston operably coupled to a needle valve member.

8. A fuel injection system comprising:

a fuel pressurizer that includes a cam driven plunger, a fuel pressurization chamber and an electronically controlled spill valve, which includes a first electrical actuator;

a needle valve having a member with a closing hydraulic surface exposed to fluid pressure in a needle control chamber;

an electronically controlled needle control valve that includes a second electrical actuator operably coupled to a control valve member that is biased toward a first position, but movable to a second position when said second electrical actuator is energized;

said needle control chamber being fluidly blocked from said fuel pressurization chamber when said control valve member is in said first position, but fluidly connected to said fuel pressurization chamber when said control valve member is in said second position; and said needle control chamber is fluidly connected to a low pressure drain when said control valve member is in either of said first and second positions.

9. The fuel injection system of claim 8 wherein said fuel pressurization chamber is disposed in a pump body that is separated from an injector body by a conduit.

10. The fuel injection system of claim 9 wherein said needle control valve includes a single seat and a stop.

11. The fuel injection system of claim 8 wherein said member is a needle piston operably coupled to a needle valve member.

12. The fuel injection system of claim 9 wherein said member is a needle valve member.

13. The fuel injection system of claim 9 wherein said needle control chamber fluidly connected to said low pressure drain via a flow restriction; and said needle control chamber is fluidly connected to said fuel pressurization chamber via an unrestricted passage when said control valve member is in said second position.

14. The fuel injection system of claim 11 where said flow restriction includes a leak clearance between said control valve member and said member of said needle valve.

15. The fuel injection system of claim 14 wherein said needle control valve includes a single seat and a stop; and said member is a needle piston operably coupled to a needle valve member.

16. A method of injecting fuel, comprising the steps of:

energizing a first electrical actuator to close a spill valve and build pressure within a fuel pressurization chamber;

de-energizing a second electrical actuator to relieve pressure in a needle control chamber and open a nozzle outlet set to inject fuel from the fuel injector; and controlling pressure in the needle control chamber at least in part by always maintaining a fluid connection between the needle control chamber and a low pressure drain.

17. The method of claim 16 wherein a fuel injection rate has a ramp shape at least in part by de-energizing said second electrical actuator before fuel pressure has reached a needle valve opening pressure, which corresponds to about a same time or before energizing the first electrical actuator.

18. The method of claim 16 wherein a fuel injection has a square shape at least in part by de-energizing said second electrical actuator after fuel pressure has reached a needle valve opening pressure, which corresponds to after energizing the first electrical actuator.

19. The method of claim 16 wherein a fuel injection sequence includes a split injection at least in part by:

energizing the second electrical actuator after energizing the first electrical actuator; and de-energizing the second electrical actuator after energizing the first electrical actuator but before fuel pressure has dropped below a needle valve closing pressure.

20. The method of claim 16 including a step of ending an injection event at least in part by one of:

maintaining the second electrical actuator de-energized until after fuel pressure has dropped below a needle valve closing pressure; or energizing the second electrical actuator before fuel pressure has dropped below a needle valve closing pressure.

* * * * *